US006948249B2

(12) United States Patent
Barone et al.

(10) Patent No.: US 6,948,249 B2
(45) Date of Patent: Sep. 27, 2005

(54) RAZOR CARTRIDGE WITH A SHAVING AID AND A METHOD OF MANUFACTURING A RAZOR CARTRIDGE

(75) Inventors: Chris A. Barone, Trumbull, CT (US); Thomas A. Follo, Milford, CT (US); Andrew J. Pennella, Stamford, CT (US); Robert R. Quintilani, North Haven, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 83 days.

(21) Appl. No.: 10/618,886

(22) Filed: Jul. 14, 2003

(65) Prior Publication Data

US 2004/0055157 A1 Mar. 25, 2004

Related U.S. Application Data

(60) Provisional application No. 60/396,672, filed on Jul. 17, 2002.

(51) Int. Cl.[7] ..... B26B 19/38
(52) U.S. Cl. ..... 30/41; 30/50
(58) Field of Search ..... 30/41

(56) References Cited

U.S. PATENT DOCUMENTS

| | | | | |
|---|---|---|---|---|
| 4,712,300 | A | 12/1987 | Hemmeter | |
| 4,809,432 | A * | 3/1989 | Schauble | 30/41 |
| 4,944,090 | A | 7/1990 | Sumnall | |
| 4,964,214 | A * | 10/1990 | Welsh et al. | 30/49 |
| 4,984,365 | A | 1/1991 | Leonard et al. | |
| 4,996,772 | A | 3/1991 | Iten | |
| 5,031,318 | A | 7/1991 | Brown et al. | |
| 5,369,885 | A | 12/1994 | Ferraro | |
| 5,604,983 | A | 2/1997 | Simms et al. | |
| 5,915,791 | A | 6/1999 | Yin et al. | |
| 6,131,287 | A | 10/2000 | Prochaska et al. | |
| 6,161,287 | A | 12/2000 | Swanson et al. | |
| 6,185,823 | B1 | 2/2001 | Brown et al. | |
| 2002/0157256 | A1 | 10/2002 | Barone | |
| 2003/0159291 | A1 | 8/2003 | Clark | |

FOREIGN PATENT DOCUMENTS

| | | |
|---|---|---|
| EP | 1 125 697 A1 | 8/2001 |

* cited by examiner

*Primary Examiner*—Allan N. Shoap
*Assistant Examiner*—Carolyn Blake
(74) *Attorney, Agent, or Firm*—Michaud-Duffy Group LLP

(57) ABSTRACT

A method for manufacturing a razor cartridge is provided that includes the steps of: (a) providing one or more razor blades, each having a length; (b) forming a body attached to the one or more razor blades, wherein the body includes a first channel aft of the one or more razor blades that is open to a contact surface of the body, and a second channel forward of the one or more razor blades that is open to the contact surface, and one or more passages extending between the first channel and the second channel; (c) injecting a shaving aid material through one or more ports into one of the first channel, second channel, or the one or more passages; wherein the one or more passages extending between the first channel and the second channel enables the shaving aid material to travel from one of the first channel, second channel, or the one or more passages into the others of the first channel, second channel, or the one or more passages.

19 Claims, 2 Drawing Sheets

RAZOR CARTRIDGE WITH A SHAVING AID AND A METHOD OF MANUFACTURING A RAZOR CARTRIDGE

This application claims the benefit of and incorporates by reference essential subject matter disclosed in U.S. Provisional Patent Application No. 60/396,672 filed on Jul. 17, 2002.

BACKGROUND OF THE INVENTION

1. Field of the Invention

The present invention relates to methods of manufacturing safety razors, and in particular to methods for manufacturing a razor cartridge for a safety razor that includes a shaving aid.

2. Background Information

Modern razor assemblies, sometimes referred to as "safety razors", often include a plurality of razor blades disposed within a cartridge that is pivotally or rigidly mounted on a handle. The razor cartridge normally includes a guard disposed forward of the blades and a cap portion disposed aft of the blades. The guard and the cap orient the position of the person's skin relative to the blades to optimize the shaving action of the blade. The terms "forward" and "aft", as used herein, define the relative position between two or more things. A feature "forward" of the razor blades, for example, is positioned so that the surface to be shaved encounters the feature before it encounters the razor blades, if the safety razor is being stroked in its intended cutting direction (e.g., the guard is forward of the razor blades). A feature "aft" of the razor blades is positioned so that the surface to be shaved encounters the feature after it encounters the razor blades, if the razor assembly is being stroked in its intended cutting direction (e.g., the cap is disposed aft of the razor blades).

Multiple razor blades are typically utilized within a razor cartridge to increase the closeness and quality of the shave produced by the razor cartridge. Multiple razor blades, however, tend to increase the razor cartridge's drag on the skin. To minimize or prevent irritation that typically accompanies drag, it is known in to attach a strip of shaving aid material to the razor cartridge. Shaving aid materials are typically water-soluble materials that lubricate or otherwise aid the skin during and after shaving to minimize or prevent the undesirable irritation.

A disadvantage of many currently available razor cartridges is that the shaving aid strip is short-lived. Once the shaving aid strip is consumed, the benefit it provides (e.g., lubrication, etc.) is also gone and undesirable irritation is increasingly possible. Another disadvantage of many currently available razor cartridges is that the shaving aid strip dispenses shaving aid at a less than desirable rate.

To optimize the effectiveness of a shaving aid material, it is advantageous to dispose a shaving aid strip between the guard and the one or more razor blades. The limited space between the guard and the one or more razor blades, however, permits only a narrow shaving aid strip. The narrow strip is difficult to manufacture using currently available techniques.

Accordingly, what is needed is method of manufacturing a razor cartridge for a razor assembly that provides a shaving aid that is likely to last longer than those currently available, and one that can be used to create narrow shaving aid passages where desired.

DISCLOSURE OF THE INVENTION

According to the present invention, a method for manufacturing a razor cartridge is provided that includes the steps of:

providing one or more razor blades, each having a length;

forming a body attached to the one or more razor blades, wherein the body includes a first channel aft of the one or more razor blades that is open to a contact surface of the body, and a second channel forward of the one or more razor blades that is open to the contact surface, and one or more passages extending between the first channel and the second channel;

providing one or more ports into at least one of the first channel, second channel, or the one or more passages; and injecting a shaving aid material through the one or more ports into one of the first channel, second channel, or the one or more passages;

wherein the one or more passages extending between the first channel and the second channel enables the shaving aid material to travel from one of the first channel, second channel, or the one or more passages into the others of the first channel, second channel, or the one or more passages.

According to an aspect of the present invention, a razor cartridge and razor assembly are provided, each including a body attached to the one or more razor blades. The body includes a contact surface, a first channel, a second channel, and one or more passages extending between the first channel and the second channel. The first channel is located aft of the one or more razor blades and is open to the contact surface. The second channel is forward of the one or more razor blades and is open to the contact surface.

An advantage of the present method and apparatus is that a shaving aid material can be inserted into all of the channels and one the passage(s) from a port or ports located in one channel or passage. As a result, the number of ports can be minimized. This is particularly advantageous in those applications where one or more of the channels or ports is too small to accept a desirable sized port.

Another advantage of the present method and apparatus is that the shaving aid material disposed in the channels and one or more passages disposed around the one or more razor blades provide additional shaving aid material surface area contiguous with the contact surface. As a result, more shaving aid material can be dispensed per stroke than is possible with many currently available razor cartridges. In addition, the additional shaving aid material surface area facilitates the provision of a longer lasting shaving aid material.

These and other objects, features, and advantages of the present invention will become apparent in light of the detailed description of the present invention.

DETAILED DESCRIPTION OF THE PRESENT INVENTION

Referring to FIGS. 1–4, a razor cartridge 10 and a method for manufacturing a razor cartridge 10 is provided herein.

Figure 1:
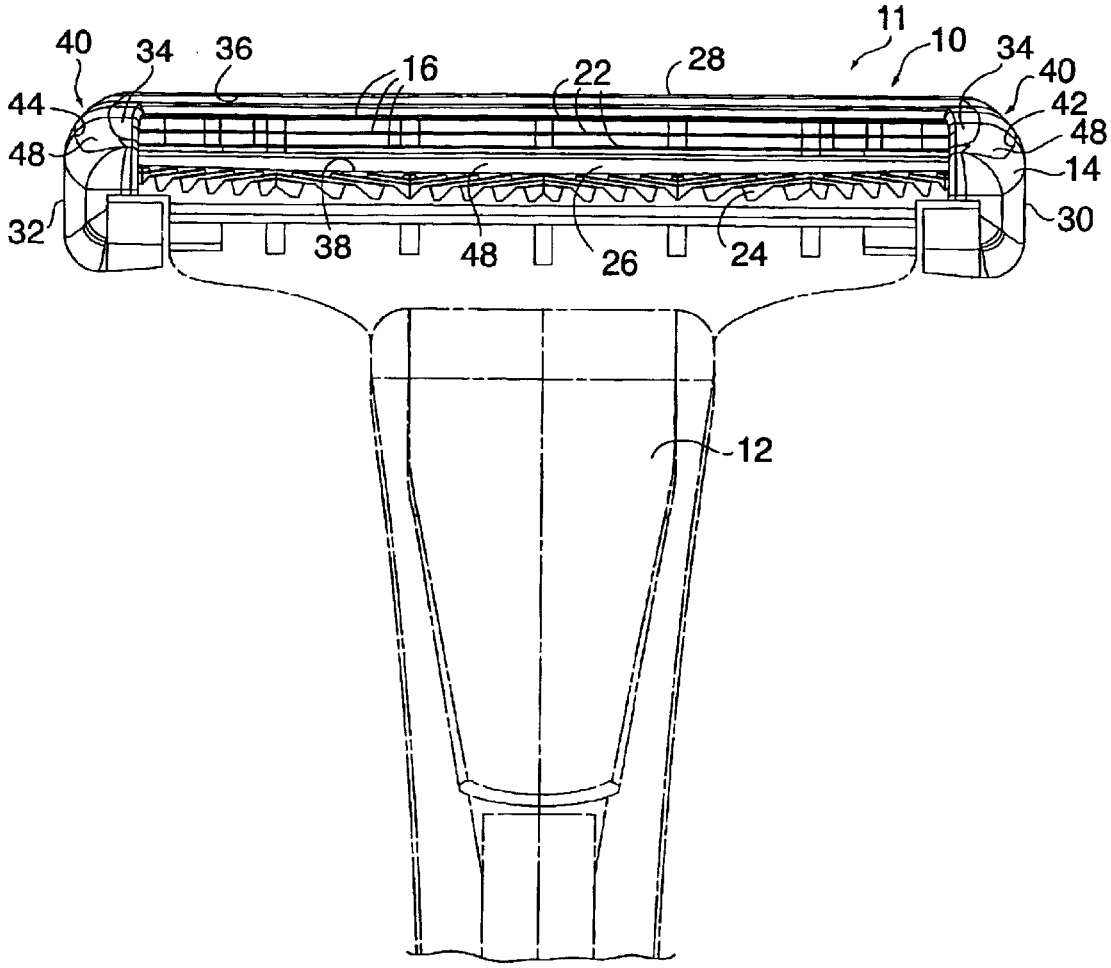
FIG. 1 is a forward view of a razor assembly including a razor cartridge and a handle.
Figure 2:
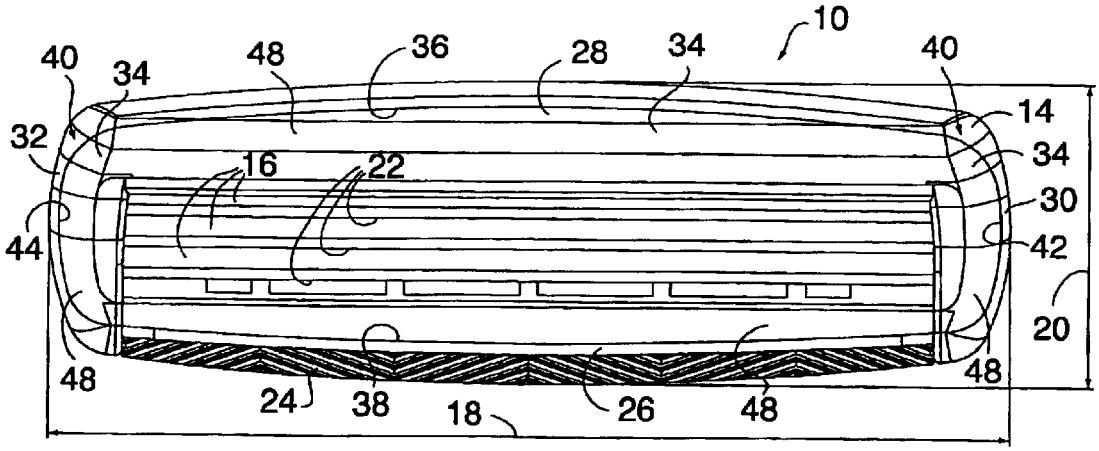
FIG. 2 is a top view of the razor cartridge shown in FIG. 1.
Figure 3:
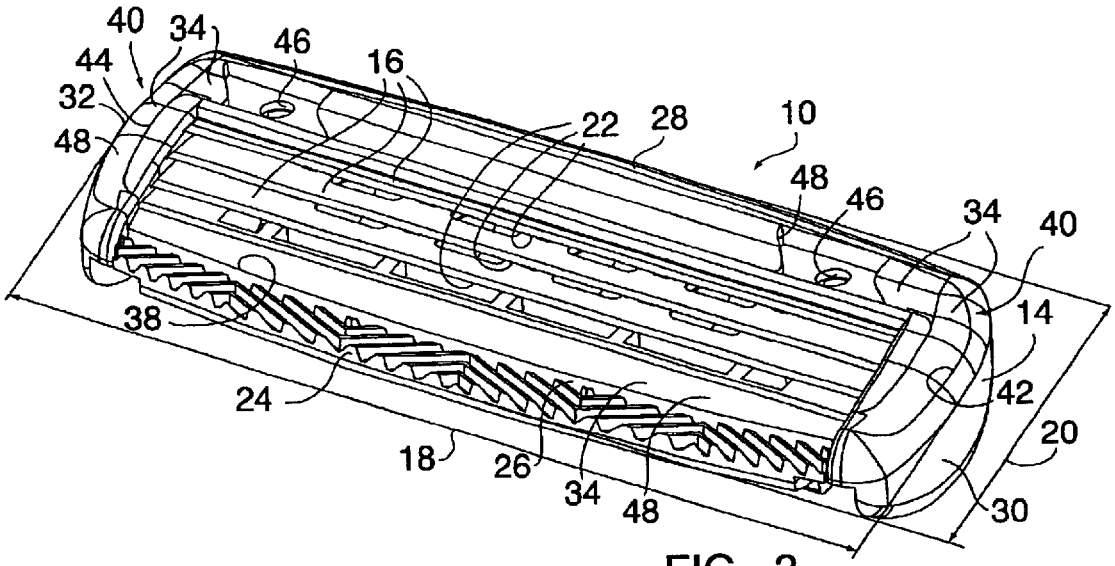
FIG. 3 is a perspective view of a razor cartridge with a shaving aid material disposed in the aft portion of the cartridge shown partially cut-away to reveal a pair of ports.
Figure 4:
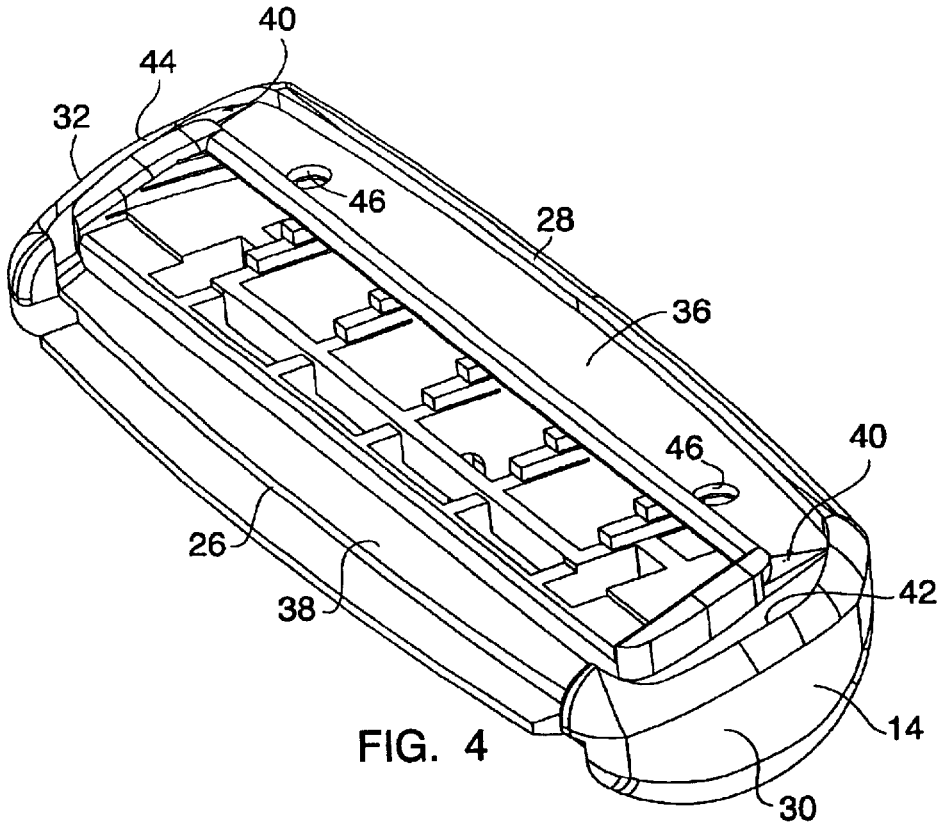
FIG. 4 is a perspective view of a razor cartridge body without shaving aid material disposed in the channels and passages.

The razor cartridge 10 pivotally or rigidly mounts on a handle 12 (shown in phantom in FIG. 1). In some applications, the razor cartridge 10 is a disposable portion of a razor assembly 11 intended to be detachable from a reusable handle 12. In other applications, the razor cartridge 10 and a handle 12 are combined into a unitary disposable razor assembly 11. In the latter form, the handle 12 and cartridge 10 are not intended to be detached from one another during normal use.

The razor cartridge 10 includes a body 14, one or more razor blades 16, a length 18, and a width 20. Each of the one or more razor blades 16 has a lengthwise extending cutting edge 22. The razor cartridge 10 preferably also includes a guard 24. A variety of guards are known and can be used with the present invention razor cartridge 10. Consequently, the present razor cartridge 10 is not limited to any particular guard.

The body 14 includes a forward portion 26, an aft portion 28, a first lateral portion 30, and a second lateral portion 32. The forward portion 26 is disposed between the guard 24 and the one or more razor blades 22. The aft portion 28 (sometimes referred to as the "cap") is disposed aft of the one or more razor blades 22. The first lateral portion 30 and second lateral portion 32 are disposed on opposite lateral sides of the one or more razor blades 22, and both extend between the forward portion 26 and the aft portion 28. The forward portion 26, aft portion 28, and the lateral portions 30,32 each have a contact surface 34. The contact surfaces 34 of the portions 26,28,30,32 may be collectively referred to as a contact surface 34 of the body 14. The contact surface 34 of the body 14 is positioned to be substantially contiguous with the surface being shaved during a normal stroke of the razor assembly 11.

A first channel 36 is disposed in the aft portion 28 of the body 14, open to the contact surface 34. A second channel 38 is located at the forward portion 26 of the body 14. In some embodiments, the second channel 38 is disposed in the forward portion 26, open to the contact surface 34 in a manner similar to the first channel 36. In other embodiments, the second channel 38 is an "open" channel lacking one or more walls. In these embodiments, the second channel 38 is disposed on a surface of the forward portion 26 that is positioned below the contact surface 34 of the body 14. Both the first channel 36 and the second channel 38 extend lengthwise across the body 14 for substantially all of the length of the one or more razor blades 16.

One or more passages 40 extend between the first channel 36 and the second channel 38. The one or more passages 40 provide fluid communication between the first channel 36 and the second channel 38. Preferably, the one or more passages 40 are formed as channels 42,44 disposed in the lateral portions, open to the contact surface 34, and the first channel 36, second channel 38, and lateral channels 42,44 form a continuous channel that encircles the one or more razor blades 16.

One or more ports 46 are disposed in one or more of the first channel 36, second channel 38, or the one or more passages 40. The one or more ports 46 are sized to permit a flow of shaving aid material therethrough. In some applications, one or more of the first channel 36, second channel 38, or one or more passages 40 has a width large enough to accept a desirable size port 46. In other instances, one or more of the first channel 36, second channel 38, or one or more passages 40 has a width that will only accept a less than desirable size port 46. In those instances, the one or more ports 46 can be positioned in the channel(s) that is wide enough to accept the desirable size port 46 as will be explained further below.

Shaving aid material 48 is disposed in the first channel 36, the second channel 38, and the one or more passages 40. The shaving aid material 48 can include one or more of a variety of constituent materials such as lubricating agents, drag reducing agents, depilatory agents, cleaning agents, medicinal agents, etc., and is not limited to any single material or combination of materials. In the preferred embodiment, the shaving aid material 48 is formed into a continuous ring that encircles the one or more razor blades 16.

The method for manufacturing the above described razor cartridge 10 includes positioning the one or more razor blades 16 in a mold in a predetermined orientation. The mold typically includes a first form and a second form that come together to create a void into which a plastic or other moldable material in inserted by injection or other process. The mold forms are shaped to produce the above-described body 14; i.e., one that includes the forward, aft, and lateral portions 26,28,30,32 as described above. Once the body material has solidified sufficiently, the second form is moved away from the first form, and a third form is positioned relative to the first form. When the third form is positioned, voids are created between the body and the third form where the first channel 36, second channel 38, and one or more passages 40 are located. As indicated above, in some embodiments the second channel 38 may be an "open" channel lacking one or more walls. In those embodiments, the third form provides the structure necessary to form the injected shaving aid material 48 into the desired shape.

Shaving aid material 48 is injected through one or more ports 46 into the voids created between the body 14 and the third form where the first channel 36, second channel 38, and one or more passages 40 are located. As indicated above, in some embodiments the one or more ports 46 are disposed within the body 14. Alternatively, the shaving aid material 48 can be injected into the voids through one or more ports 46 disposed within the third form. The one or more ports 46 are preferably aligned with a channel 36,38,40 having a width that will accept a desirable port size. If, for example, it is desirable to have a second channel 38 substantially more narrow than a first channel 36, then one or more ports 46 can be disposed in the first channel 36. The larger port(s) 46 possible within the first channel 36 facilitates the injection of the shaving aid material 48. Once the shaving aid material 48 is injected into the first channel 36 and/or the one or more passages 40, the shaving aid material 48 subsequently travels into the smaller second channel 38. Specifically, the one or more passages 40 extending between the first channel 36 and the second channel 38 enable shaving aid material 48 to flow during the injection process from the first channel 36 and/or the one or more passages 40 into the smaller second channel 38. As a result, shaving aid material 48 can be disposed within a relatively small channel with out the undesirable characteristics associated with injecting via a small port 46.

Although this invention has been shown and described with respect to the detailed embodiments thereof, it will be understood by those skilled in the art that various changes in form and detail thereof may be made without departing from the spirit and scope of the invention. For example, a plurality of the channels can be formed as "open" channels, each lacking one or more walls. In another example, the channels 36,38 and one or more passages 40 are described above as being disposed within the body 14 of the razor cartridge 10. In an alternative method, the channels 36,38 and one or more passages 40 could be disposed in a form used to mold the shaving aid material.

What is claimed is:

1. A method for manufacturing a razor cartridge, comprising the steps of:

providing one or more razor blades, each having a length;

forming a body attached to the one or more razor blades, wherein the body includes a first channel aft of the one or more razor blades, a second channel forward of the one or more razor blades, and one or more passages extending between the first channel and the second channel;

injecting a shaving aid material into at least one of the first channel, second channel, or the one or more passages;

wherein the one or more passages extending between the first channel and the second channel enables the shaving aid material to travel from the one of the first channel, the second channel, or the one or more passages into the others of the first channel, the second channel, or the one or more passages.

2. The method of claim 1, wherein the body further comprises one or more ports disposed in one or more of the first channel, second channel, and one or more passages, and wherein the shaving aid material is injected through the one or more ports.

3. The method of claim 2, wherein the one or more ports are disposed in the first channel.

4. The method of claim 2, wherein the one or more ports are disposed in the one or more passages.

5. The method of claim 1, wherein each of the one or more passages is disposed on a lateral side of the one or more razor blades.

6. The method of claim 1, wherein the one or more passages and in fluid communication with the first and second channels.

7. The method of claim 6, wherein the one or more passages include a first lateral channel and a second lateral channel, wherein the first lateral channel and the second lateral channel are disposed on opposite lateral sides of the one or more razor blades.

8. The method of claim 7 wherein the first channel and the second channel both extend substantially the entire length of the one or more razor blades.

9. The method of claim 1, wherein in the step of injecting shaving aid material into one of the first channel, second channel, or the one or more passages, enough shaving aid material is injected to substantially fill the first channel, second channel, and the one or more passages.

10. The method of claim 9, wherein the step of forming the body includes utilizing a first form and a second form, and wherein the body comprises a material and the material is injected in a void between the first form and the second form.

11. The method of claim 10, further comprising the step of forming the shaving aid material, which includes providing a third form to be coupled with the first form.

12. The method of claim 11, wherein when the shaving aid material is injected into at least one of the first channel, second channel, or the one or more passages, the body is disposed between the first form and the third form.

13. The method of claim 12, wherein the third form includes one or more ports aligned with one or more of the first channel, second channel, and one or more passages, and wherein the shaving aid material is injected through the one or more ports.

14. A method for manufacturing a razor cartridge, comprising the steps of:

providing one or more razor blades, each having a length;

forming a body attached to the one or more razor blades;

positioning a form contiguous with the body, wherein the form includes a first channel aft of the one or more razor blades, a second channel forward of the one or more razor blades, and one or more lateral channels extending between the first channel and second channel, wherein the one or more channels are disposed on one or both lateral sides of the one or more razor blades;

injecting a shaving aid material into at least one of the first channel, second channel, or the one or more lateral channel;

wherein the one or more lateral channels extending between the first channel and the second channel enables the shaving aid material to travel from the one of the first channel, second channel, or the one or more lateral channels into the others of the first channel, second channel, or the one or more passages.

15. A method for manufacturing a razor assembly, comprising the steps of:

providing one or more razor blades, each having a length;

forming a body attached to the one or more razor blades, wherein the body includes a first channel aft of the one or more razor blades, a second channel forward of the one or more razor blades, and one or more passages extending between the first channel and the second channel;

injecting a shaving aid material into at least one of the first channel, second channel, or the one or more passages;

wherein the one or more passages extending between the first channel and the second channel enables the shaving aid material to travel from the one of the first channel, the second channel, or the one or more passages into the others of the first channel, the second channel, or the one or more passages; and attaching a handle to the body.

16. The method of claim 15, wherein in the step of injecting shaving aid material into one of the first channel, second channel, or the one or more passages, enough shaving aid material is injected to substantially fill the first channel, second channel, and the one or more passages.

17. The method of claim 16, wherein the step of forming the body includes utilizing a first form and a second form, and wherein the body comprises a material and the material is injected in a void between the first form and the second form.

18. The method of claim 17, further comprising the step of forming the shaving aid material, which includes providing a third form to be coupled with the first form.

19. The method of claim 18, wherein when the shaving aid material is injected into at least one of the first channel, second channel, or the one or more passages, the body is disposed between the first form and the third form.

* * * * *